US005815930A

United States Patent [19]

Kojima

[11] Patent Number: 5,815,930

[45] Date of Patent: Oct. 6, 1998

[54] NON-METALLIC STRAP CUTTER

[76] Inventor: Kimberly Kojima, 2167 Green River Rd., Williamstown, Mass. 01267

[21] Appl. No.: 871,293

[22] Filed: Jun. 9, 1997

[51] Int. Cl.[6] ..... B26B 3/00

[52] U.S. Cl. ..... 30/294; 30/280; 280/801.1

[58] Field of Search ..... 30/296.1, 298.4, 30/286, 340, 2, 280; 280/801.1; 297/468

[56] References Cited

U.S. PATENT DOCUMENTS

| | | | |
|---|---|---|---|
| 2,805,476 | 9/1957 | Bishaf | 30/340 X |
| 4,730,409 | 3/1988 | Mitchell et al. | 30/296.1 X |
| 5,085,449 | 2/1992 | Hudson | 30/296.1 X |
| 5,127,162 | 7/1992 | Mansfield | 30/280 X |

*Primary Examiner*—Douglas D. Watts

[57] ABSTRACT

A simple, compact and easily useable cutting device for cutting non-metallic straps, wherein a hand held plastic frame is provided with a metallic sharpened blad held in a substantially vertical position in one embodiment and in a substantially horizontal position in another embodiment, with the frame having a lower leg for holding the strap looped thereabout and held by a vertical protrusion, and wherein horizontal movement device while holding the looped strap securely the one embodiment blade cuts the strap through the edge thereof, and wherein by rotating the device while securely holding the looped strap, the other embodiment blade cuts the strap through the edtge first and then through the bottom width of the strap.

10 Claims, 1 Drawing Sheet

NON-METALLIC STRAP CUTTER

BACKGROUND OF THE INVENTION

1. Field of Invention

This invention relates to a non-metallic strap cutter, and more particularly to such a cutter that is simple to operate, is compact, and is inexpensive to manufacture.

2. Discussion of Prior Art

Often a scissor is used to cut non-metallic straps; however, such scissor may not be readily available. A scissor cannot be always carried around. A simple, compact and inexpensive cutter would be of immense value to the user of non-metallic straps.

SUMMARY OF THE INVENTION

Accordingly, an object of the invention is to overcome the aforementioned and other deficiences and disadvantages of the prior art.

Another object is to provide a cutter which is simple to operate, compact in structure, and inexpensive to manufacture.

A further object is to provice a cutter having a sharpened metallic blade which is molded within a plastic holder in such a position that a non-metallic strap is cut by the blade through an edge of the strap by moving the blade perpendicular to the flat side of the strap, or in an alternative arrangement by moving the blade upwardly in a circular movement with the strap being held against the blade and held stationary in the cutter holder.

DETAILED DESCRIPTION OF THE PREFERRED EMBODIMENTS

Figure 1:
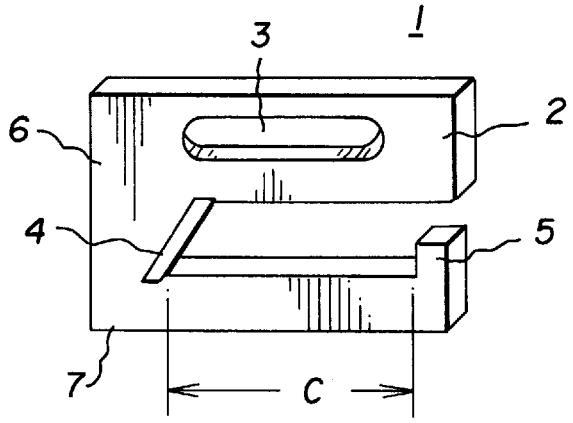
FIG. 1 is a perspective view of an illustrative embodiment of the invention.
Figure 3:
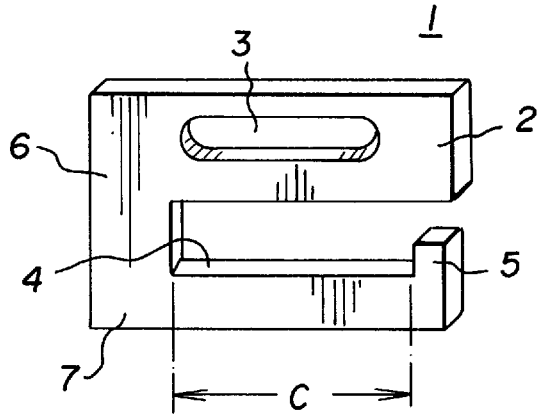
FIG. 3 is a perspective view depicting another illustrative embodiment of the invention.
Figure 4:
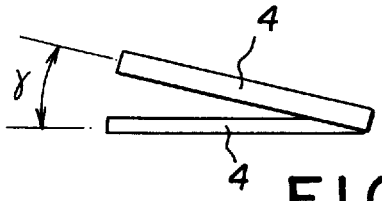
FIG. 4 is a view showing different angular positions of the blade of FIG. 3.
Figure 5:
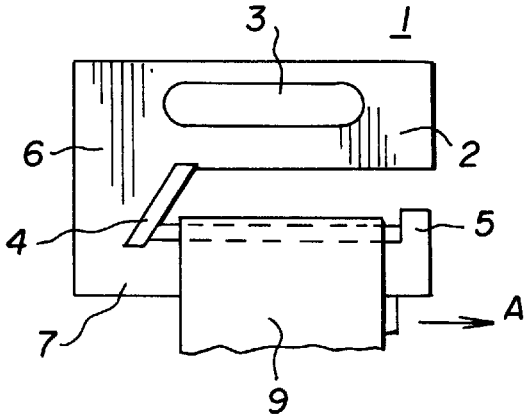
FIG. 5 shows direction of movement of the embodiment of FIG. 1 when cutting the strap.

FIGS. 1–6 show a cutting device 1 comprising a frame comprising an upper portion 2 with a hole or indentation 3 therein, an end portion 6, a lower portion 7 having a vertically disposed protrusion 5 at the end thereof, for example, at right angles, and a sharpened metal blade 4 held by a portion of the frame, such as by molding of the frame with such blade 4 being molded integrally with the frame in a manner known in the plastic molding art. In FIGS. 1, and 5, the blade 4 is molded at the end portion 6, and in FIGS. 3 and 6, the blade 4 is molded at the bottom portion 7. The blade 4 is a sharpened metal similar to those readily available in disposable razors. The frame is formed of a plastic resin and formed, for example, by injection molding or the like. The hole 3 is of suitable circular or elliptical or rectangular shape, or like shaped indentation, for holding, for example by the human thumb and index finger when the cutting device 1 is used to cut a non-metallic strap 9, which may be of an embossed plastic material, of the type now in general use.

Figure 6:
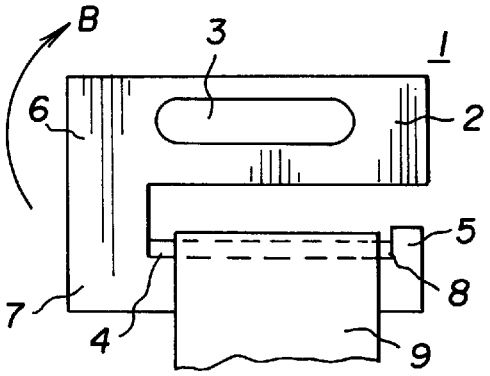
FIG. 6 shows the rotation direction of movement of the blade in the embodiment of FIG. 3 when cutting the strap.

The distance C between protrusion 5 and blade 4 in FIGS. 1 and 5, or end portion 6 in FIGS. 3 and 6, is slightly larger than the width of strap 9 to be cut by the cutting device 1. The straps now in general use ranges from ⅜ to ⅝ inch.

Figure 2:
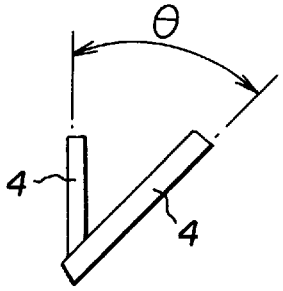
FIG. 2 is a view showing different angular positions of the blade of FIG. 1.

As shown in FIG. 2, the blade 4 of the first embodiment of FIGS. 1 and 5 may be formed by injection molding at the vertical end portion 6, and be at an angle θ ranging from 0° to 45° from the vertical dimension.

Similarly, as shown in FIG. 4, the blade 4 of the second embodiment of FIGS. 3 and 6, may be formed by injection molding at the horizontal bottom portion 7, and be at an angle δ ranging from 0° to 45° from the horizontal dimension.

As shown in FIG. 5, the cutting device 1 of the first embodiment is used to cut strap 9 in the following manner. First the strap 9 is looped flat over the bottom portion 7 between protrusion 5 and blade 4, and held by, for example the left hand, so that the strap 9 is securely held in the looped position. Then, the cutting device 1 is moved to the right as shown by arrow A, with, for example, the user's right thumb and index finger holding the top portion 2 using hole or indentation 3, with the left hand holding the looped strap. The blade 4, which is made of sharpened steel, for example, cuts the strap 9 by cutting through the edge thereof.

It has been found, through experimentation, that for the first embodiment, the blade 4 is preferably to be disposed at a vertical position, or at an angle of up to 45° to the vertical line. Other angles would not be as effective. The 0°–45° appears to be most effective because the blade 4 is between a positive cutting angle to a right angle cutting angle. Above or below the range of 0° to 45° to the vertical is not as effective in cutting the strap.

As shown in FIG. 6, the cutting device 1 of the second embodiment is used to cut strap 9 in a different manner from the embodiment of FIGS. 1 and 3. First, the strap 9 is looped flat over the blade 4 molded to the bottom portion 7 between protrusion 5 and end portion 5, and held by the left hand so that the strap 9 is held against securely in the looped position. Then, with the strap 9 held against protrusion 5, the cutting device is rotated upward as shown by arrow B around the pivot point 8 located at the intersection of bottom portion and blade and the protrusion, with for example the user's right thumb and index finger holding the top portion 2 using hole or indentation 3 with the left hand holding the looped strap. Then, blade 4, which is made of sharpened steel, for example, cuts the strap 9 by the blade 4 cutting first the edge and then by upward movement through the width dimension.

It has been found, through experimentation, that for the second embodiment, the blade 4 is preferable to be disposed at a horizongal position, or at an angle of up to 45° to the horizontal line. Other angles are not as effective. The 0° to 45° appears to be the most effective because the blade 4 is between a positive cutting angle to a right angle cutting angle. Above or below the range of 0° to 45° to the horizontal is not as effective in cutting the strap.

The cutout or indentation 3 can be an open hole or a closed indentation panel in the upper portion 2 so that the user can place his/her thumb and finger thereon to hold the cutting device 1 for cutting operation. The rectangular shape of the embodiments is only illustrative, and other geometric shapes can be used. For example, the frame may be elliptical.

The foregoing is illustrative of the principles of the invention. Numerous extensions and modifications thereof would be apparent to the worker skilled in the art. All such extensions and modifications are to be considered to be within the spirit and scope of the invention.

What is claimed is:

1. A device for cutting a loose non-metallic strap consisting of:

a frame consisting of an upper portion having two ends, a flat horizontal part, and a handle part;

a bottom portion having two ends and a flat horizontal part between said two ends and positioned opposite the flat horizontal part of said upper portion;

an end portion having a flat vertical part and interconnecting one end of each of said upper portion and said bottom portion so that two right angles are formed by said flat vertical part of said end portion and said flat horizontal parts of said bottom portion and said upper portion, respectively; and a protrusion having a flat vertical part and extending vertically from another end of said bottom portion toward another end of said upper portion so that a right angle is formed by said flat vertical part of said protrusion and said flat horizontal part of said bottom portion with an opening defined between said protrusion and said other end of said upper portion with said flat horizontal part of said bottom portion located between said flat vertical part of said protrusion and said flat vertical part of said end portion being of a dimension suitable for holding a width of said strap; and a single sharpened metallic blade attached to said vertical part of said end portion between said upper portion and said bottom portion and generally facing toward said protrusion;

whereby said strap is inserted with a flat surface of said strap horizontally disposed through said opening and disposed flat with said flat surface horizontal between the protrusion and the end portion, and the handle part of said upper portion is moved to cause the blade to first cut an edge of said strap while the protrusion exerts horizontal force on said strap by horizontally holding said strap during the intial cutting of the edge, and thereafter the entire width of said strap is cut by said blade.

2. A device of cutting a loose non-metallic strap consisting of:

a frame consisting of an upper portion having two ends, a flat horizontal part, and a handle part;

a bottom portion having two ends and a flat horizontal part between said two ends and positioned opposite the flat horizontal part of said upper portion;

an end portion having a flat vertical part and interconnecting one end of each of said upper portion and said bottom portion so that two right angles are formed by said flat vertical part of said end portion and said flat horizontal parts of said bottom portion and said upper portion, respectively; and a protrusion having a flat vertical part and extending vertically from another end of said bottom portion toward another end of said upper portion so that a right angle is formed by said flat vertical part of said protrusion and said flat horizontal part of said bottom portion with an opening defined between said protrusion and said other end of said upper portion with said flat horizontal part of said bottom portion located between said flat vertical part of said protrusion and said flat vertical part of said end portion being of a dimension suitable for holding a width of said strap; and a single sharpened metallic blade attached to said horizontal part of said bottom portion between said flat vertical parts of said protrusion and said end portion and facing generally toward said upper portion;

whereby said strap is inserted with a flat surface of said strap horizontally disposed through said opening and disposed flat with said flat surface horizontal between the protrusion and the end portion, and the handle part of said upper portion is rotated to cause the blade to first cut an edge of said strap while the protrusion exerts horizontal force on said strap by horizontally holding said strap during the initial cutting of the edge, and thereafter the entire width of said strap is cut by said blade.

3. The device of claim 1, wherein said blade is disposed at a right angle to said bottom flat horizontal part.

4. The device of claim 1, wherein said blade is disposed at an angle ranging from 0° to 45° to the right angle to the bottom flat horizontal part.

5. The device of claim 1, wherein said handle means comprises a hole in said upper portion.

6. The device of claim 1, wherein said handle means comprises an indented panel in said upper portion.

7. The device of claim 2, wherein said blade is disposed substantially horizontally.

8. The device of claim 2, wherein said blade is disposed at an angle ranging between 0° to 45° horizontal to the bottom portion.

9. The device of claim 2, wherein said handle means comprises a hole in said upper portion.

10. The device of claim 2, wherein said handle means comprises an indented panel on said upper portion.

* * * * *